US005304076A

United States Patent [19]

Pelton et al.

[11] Patent Number: 5,304,076

[45] Date of Patent: Apr. 19, 1994

[54] LAMP ELECTRICAL CONTACT

[75] Inventors: Bruce A. Pelton, Manteca, Calif.; Peter E. Lowe, Knoxville, Tenn.; Randy J. Bleske, San Jose, Calif.

[73] Assignee: Lumatech, Emeryville, Calif.

[21] Appl. No.: 873,099

[22] Filed: Apr. 24, 1992

[51] Int. Cl.[5] ..... H01R 33/76

[52] U.S. Cl. ..... 439/683; 439/857

[58] Field of Search ..... 439/683, 617, 619, 851, 439/856, 857, 226, 232, 660

[56] References Cited

U.S. PATENT DOCUMENTS

| | | | |
|---|---|---|---|
| 2,188,530 | 1/1940 | Camp | 439/851 |
| 3,783,437 | 1/1974 | Graff et al. | 439/619 |
| 4,192,565 | 3/1980 | Gianni | 439/851 |
| 4,560,231 | 12/1985 | Shirai | 439/851 |
| 4,592,615 | 6/1986 | Durand | 439/619 |
| 4,623,823 | 11/1986 | Engel | 439/660 |
| 4,631,377 | 12/1986 | Imazeki et al. | 439/619 |

FOREIGN PATENT DOCUMENTS

| | | | |
|---|---|---|---|
| 2064235 | 6/1981 | United Kingdom | 439/851 |

*Primary Examiner*—Larry I. Schwartz
*Assistant Examiner*—Hien D. Vu
*Attorney, Agent, or Firm*—Ware and Freidenrich

[57] ABSTRACT

An electrical contact for a lamp having at least one electrical jack employed in conjunction with lamp housing and an electrical conductor. The contact includes a body element possessing a first end portion, second end portion, and an intermediate turned or bent portion. The body element is constructed of flexible conductive material to permit bending of the first and second end portions relative to one another. A pair of flexible flanges extend from the first portion and serve to form a channel and to contact the lamp electrical jack. The flanges include at least one edge portion capable of scrapping the lamp electrical jack. The electrical conductor connects to the second end portion of the body element which is held to the lamp housing.

7 Claims, 2 Drawing Sheets

LAMP ELECTRICAL CONTACT

BACKGROUND OF THE INVENTION

The present invention relates to a novel electrical contact for a lamp having at least one electrical jack.

Plug-in fluorescent lamps have become quite common in recent times as replacements for incandescent screw-in lamps. For example, reference is made to U.S. Pat. No. 4,623,823 which describes the use of such "PL lamp" with an electrical adaptor. The adaptor shown in U.S. Pat. No. 4,623,823 utilizes a toroidal ballast which lies between the Edison base and the portion of the adaptor supporting the contact pins of the PL lamp.

In the past, electrical and mechanical connection between the adaptor unit and the PL lamp has taken the form of soldering and insulating wires and connectors, and the employment of bulky wire supports within the lamp housing. In addition, the prior connectors or contacts used in conjunction with lamps having pin contacts are subject to corrosion and oxidation and are not reusable. Moreover, installation of the prior art connectors is labor intensive.

An electrical contact for a lamp having pin contacts which is compact, easy to install, and controls potentially interfering oxidation would be notable advance in the lighting field.

SUMMARY OF THE INVENTION

In accordance with the present invention a novel and useful lamp electrical contact is herein provided.

A electrical contact herein described applies to a lamp having at least one electrical jack. For example, plug-in fluorescent lamps of the PL or quad type are included in this category. Typically, such plug-in lamps are used with a housing and must be connected through the housing to an electrical conductor which feeds electrical power to the lamp from electrical components such as a fluorescent ballast.

The contact of the present invention includes a body element having a first end portion, a second end portion, and an intermediate turned or bent portion, connecting the first and second end portions. The body element is constructed of flexible electrically conductive material which is preferably resilient, possessing memory. Thus, the first and second end portions are opposed to one another and bendable relative to one another.

In order to mechanically and electrically hold the lamp electrical jack, a pair of flexible flanges are provided to extend from the first portion of the body element. The pair of flexible flanges are spaced apart to form a channel and to contact the lamp electrical jack when the same is placed between the pair of flexible flanges. In addition, the pair of flexible flanges include edge portions which are capable of scraping the lamp electrical jack when placed between the pair of flexible flanges. As is the case with the body element first and second end portions, the first and second flanges are preferably formed of resilient material that exhibits a springy characteristic. Specifically, the pair of flexible flanges may be angularly oriented relative to one another requiring the lamp contact to spread the same when placed within the channel between the pair of flexible flanges. The scraping edge portions of the pair of flexible flanges could be mitred to lessen the scraping friction occurring when the lamp jack is placed between the pair of flexible flanges.

Means is also included in the present invention for holding the body element to the lamp housing. Such means may take the form of an orifice formed in the housing of the lamp or lamp adaptor. The orifice would include a surface or shelf capable of engaging a shoulder or edge portion of the pair of flexible flanges when the same is manually inserted into the orifice. In certain cases, the portion of the housing forming the orifice may take the form of a partition, in which case, the orifice would externalize in a tunnel passing through such partition. It should be noted that a resilient relationship between the first and second portions of the body element would prevent disengagement of the body element from the surface or shelf of the orifice once the body element is placed in the orifice.

Means is also included in the present invention for connecting second end portion of the body element to the electrical conductor or wire. The second end portion of the body element may include a protuberance and may itself extend outside the orifice portion of the housing. Thus, the second end portion is accessible for soldering while using the protuberance to temporarily hold the wire in place. The housing may also provided ribs or walls to shield the second end portion of the body element and connected wire within the lamp adaptor housing.

It may be apparent that a novel and useful electrical contact for a plug-in lamp has been described.

It is therefore an object of the present invention to provide an electrical contact for a lamp which may be manually fixed to the lamp housing without employment of fasteners.

It is another object of the present invention to provide an electrical contact for a lamp which may be removed from its operating position and reused at a later time.

A further object of the present invention is to provide an electrical contact for a lamp which provides a wiping or scraping comtact relative to the lamp jack when the same is inserted within the electrical contact.

Yet another object of the present invention is to provide an electrical contact for a lamp which permits a lamp adaptor housing unit to be formed more compactly than prior art lamp housing.

Another object of the present invention is to provide a electrical contact for a lamp which obviates the need for insulating the connection point between the contact and an electrical conductor or wire.

The invention possesses other objects and advantages especially as concerns particular characteristics and features thereof which will become apparent as the specification continues.

For a better understanding of the invention reference is made to the following detailed description of the preferred embodiments which should be referenced to the prior described drawings.

DESCRIPTION OF THE PREFERRED EMBODIMENTS

Figure 1:
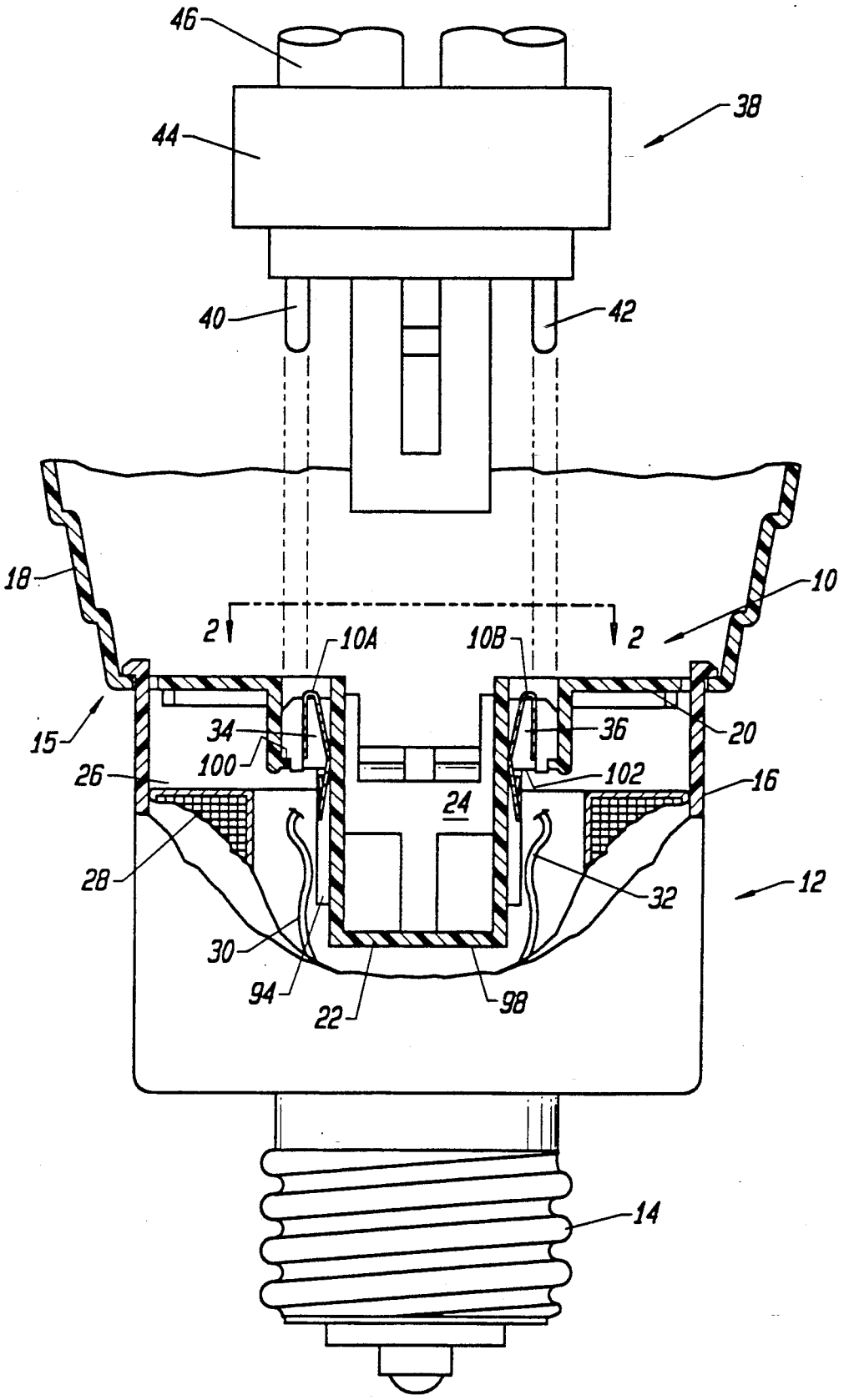
FIG. 1 is a front elevation view of a fluorescent lamp adaptor unit depicting a pair the electrical contact of the present invention in section and the plug-in electrical lamp in exploded configuration.

The invention as a whole is shown in the drawings by reference character 10. The electrical contact 10 is used in. conjunction with a lamp adaptor 12 including an Edison base 14 and housing 15. Housing 15 includes a base portion 16 as well as a reflector 18. Partition member 20 possesses a pendant part 22 forming an orifice or cavity 24. Base portion 16 and partition member 20 may be formed of electrically insulative material such as plastic and the like. Chamber 26 within base portion 16 contains electrical components such as toroidal ballast 28. Conductors 30 and 32 lead from Edison base 14 and ballast 28 upwardly toward partition 20. Duplicate electrical contacts 10 of the present invention are shown in FIG. 1 and are designated 10A and 10B to differentiate positions. Cavities 34 and 36 are formed through partition 20 to permit electrical and mechanical fixation of fluorescent lamp 38 with contacts 10A and 10B. Likewise, conductors 30 and 32 electrically connected to contacts 10A and 10B in any suitable manner such as soldering crimping and the like. The details of such interconnection will be described hereinafter. Fluorescent lamp 38 includes a pair of pins or jacks 40 and 42 which extend from base 44. U-shaped fluorescent tube 46, shown partially in FIG. 1, extends upwardly from base 44.

Figure 4:
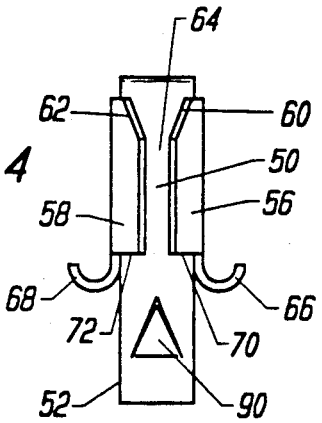
FIG. 4 is a front elevational view of the electrical contact of the present invention depicted in FIG. 3.
Figure 3:
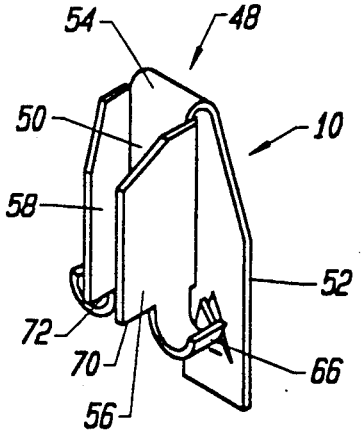
FIG. 3 is a top right perspective view of an embodiment of the electrical contact of the present invention.

With reference to FIGS. 3 and 4, it may be observed that electrical contact 10 is depicted and includes a body element 48 constructed of electrically conductive material such as copper and the like. The structure of contact 10 is identical to contacts 10A and 10B may be considered exemplar of the same. Body element 48 possesses a first end portion 50, a second end portion 52, and an intermediate turned or bent portion 54. Turned portion 54 connects to first and second end portions 50 and 52, which are in generally in opposed configuration. Since body element 48 is constructed of resilient material first and second end portions 50 and 52 are bendable relative to one another and capable of springing back to a former position without deformation. The usefulness of this memory characteristic will be explained hereinafter.

Figure 2:
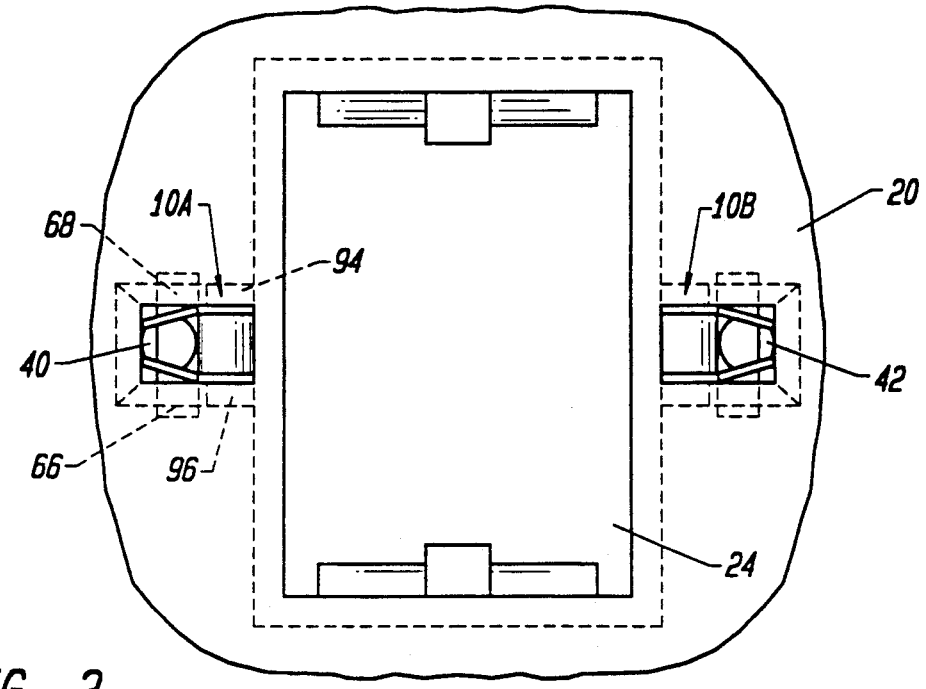
FIG. 2 is a section view take along line 2—2 of FIG. 1.

A pair of flexible flanges 56 and 58 extend outwardly from first end portion 50 in a non-orthogonal manner. Again, flanges 56 and 58 may exhibit memory or resiliency such that forcing flanges 56 and 58 apart will institute a pressure by such flanges toward one another. Flanges 56 and 58 include, mitred edges 60 and 62 which are capable of scraping or wiping pins 40 and 42 of fluorescent lamp 38 when they are inserted with electrical contacts 10A and 10B, FIG. 2. With reference to FIG. 4, it may be noted that flanges 56 and 58 form a channel 64 to accommodate the pins or jacks of lamp 38. Semi-circular ears 66 and 68 extend laterally from flanges 56 and 58 leaving free edges 70 and 72.

Figure 5:
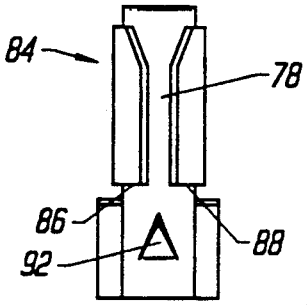
FIG. 5 is a front elevation view of another embodiment of the electrical contact of the present invention.
Figure 6:
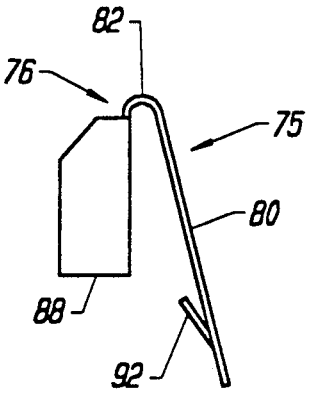
FIG. 6 is a side view of another embodiment of the electrical contact of the present invention depicted in FIG. 5.

FIGS. 5 and 6 represent an alternate embodiment 75 of the electrical contact of the present invention. Contact 74 has a body element 76 with a first portion 78, second portion 80 and turned portion 82 connecting first and second portions 78 and 80. A pair of flanges 84 extend obliquely from first portion 78 in the same manner as embodiment 10 herein. Likewise resiliency is exhibited between a pair of flanges 84 and first and second portions 78 and 80 of body element 76. Edges 86 and 88 are formed on a pair flanges 84 without any lateral structure. End portion 80 of contact 74 and second portion 52 of contact 10 include lances or barbs 90 and 92, respectively, which function to temporarily hold conductors 30 or 32 for the purpose of soldering. Other structures, such as loops, may also serve as holders for conductors 30 and 32.

In operation, the user assembling lamp adaptor 12 would insert electrical contacts 10A and 10B within orifices 34 and 36 of partition 20. Orifices pass from chamber 26 to inner portion of reflector 18. Conductors 30 and 32 would be connected to the lances of contacts **10*a* and 10B exemplified, by lance 90 of electrical contact 10 FIG. 4, and soldered thereto. It should be noted that exemplar second end portion 52 of body element 48 of contact 10 extends outside of orifices 34 or 36 as the case may be. Walls 94 and 96 extend downwardly along exterior surface 98 of pendant part 22 to partially shield exemplar second end portion 52 of body element 48 which lies outside of cavity or orifice 34, with respect to electrical contact 10A on FIG. 1. Similar wall portions shield exemplar second end portion 52 of contact 10B. Again, with reference to electrical contact 10, and in particular contact 10A, body element 48 is forced into cavity 34 such that first and second end portions 50 and 52 spring away from one another within cavity 34. Free edges 70 and 72 contact shelf 100 within cavity 34 which prevents removal downwardly of contact 10 from cavity 34. Semi-circular ears 66 and 68 engage the lower edge 102 of partition 20 to prevent removal from cavity 34 upwardly. Electrical contact 10B is inserted into cavity 36 in the same manner. The user then inserts pins 40 and 42 of fluorescent lamp 38 within cavity 64 formed by flanges 56 and 58. Mitred edges 60 and 62 scrap or wipe the outer surfaces of pins 40 and 42, thus removing corrosion or other fouling material. The embodiment 75 depicted in FIGS. 5 and 6 is inserted in the same manner within a cavity such as cavity 34 such that edges 86 and 88 rest on shelf 100 therewithin. Locking lateral ears 66 and 68 of, embodiment 75 resist removal upwardly by of the spreading force between first and second portions 78 and 80. Lamp 38 is removable from contact 10 or 74** and reinsertable as desired.

While in foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An electrical contact for a lamp having at least one electrical jack and being employed in conjunction with a lamp housing and an electrical conductor, comprising:

a. a body element having a first end portion, a second end portion, and an intermediate turned portion connecting said first and second end portions, said body element being constructed of a flexible electrically conductive material such that said first and second end portions are bendable relative to one another;

b. a pair of flexible resilient flanges extending from said first end portion of said body element, said pair of flexible flanges being spaced apart to form a channel for the lamp electrical jack and to contact the lamp electrical jack, said pair of flexible flanges further including at least one edge portion capable of scraping the lamp electrical jack, said pair of flexible resilient flanges being capable of exerting pressure toward one another;

c. means for electrically connecting said second end portion of said body element to the electrical conductor; and d. means for holding said body element to the lamp housing.

2. The electrical contact of claim 1 in which said pair of flexible flanges are angularly oriented relative to one another.

3. The electrical contact of claim 1 in which each of said edge portions of said pair of flexible flanges are mitred.

4. The electrical contact of claim 1 in which said first portion of said body element is resiliently connected to said intermediate turned portion of said body element.

5. The electrical contact of claim 1 in which said means for electrically connecting said second end portion of said body element to the electrical conductor includes a lance extending from said second end portion.

6. The electrical contact of claim 1 in which said means for holding said body element to the lamp housing includes said pair of flexible flanges including a ear, and the lamp housing including an orifice having a surface, said shoulder being capable of contacting said surface upon entry into said orifice.

7. An electrical contact for lamp having at least one electrical jack and being employed in conjunction with an electrical conductor, comprising:

a. a body element having a first end portion, a second end portion, and an intermediate turned portion connecting said first and second end portions, said body element being constructed of a flexible electrically conductive material such that said first and second end portions are bendable relative to one another;

b. a pair of flexible, resilient flanges extending from said first portion of said body element, said pair of flexible flanges being spaced apart to form a channel for the lamp electrical jack and to contact the lamp electrical jack, and each of said pair of flexible flanges further including at least one edge portion capable of scraping the lamp electrical jack, said pair of flexible resilient flanges being capable of exerting pressure toward one another; and c. means for electrically connecting said second end portion of said body element to the electrical conductor.

* * * * *